US009958172B2

(12) United States Patent
Uselton et al.

(10) Patent No.: US 9,958,172 B2
(45) **Date of Patent: *May 1, 2018**

(54) DEHUMIDIFIER HAVING SPLIT CONDENSER CONFIGURATION

(71) Applicant: Lennox Industries Inc., Richardson, TX (US)

(72) Inventors: Robert B. Uselton, Plano, TX (US); Mark Cree Jackson, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/485,418

(22) Filed: Apr. 12, 2017

(65) Prior Publication Data

US 2017/0219225 A1 Aug. 3, 2017

Related U.S. Application Data

(62) Division of application No. 13/300,909, filed on Nov. 21, 2011, now Pat. No. 9,631,834.

(51) Int. Cl.
*F24F 5/00* (2006.01)

(52) U.S. Cl.
CPC ..... *F24F 5/00* (2013.01)

(58) Field of Classification Search
CPC .. F24F 13/30; F24F 1/14; F24F 3/1405; F24F 2013/225; F24F 7/02; F25B 6/04; F25B 5/00; Y10T 29/49359
See application file for complete search history.

(56) References Cited

U.S. PATENT DOCUMENTS 4,827,733 A * 5/1989 Dinh ..... F24F 1/022 62/119
4,938,035 A * 7/1990 Dinh ..... F24F 1/022 62/279
5,237,831 A * 8/1993 Sikora ..... F24F 1/022 165/86
5,343,632 A * 9/1994 Dinh ..... F26B 21/086 34/507
5,579,647 A * 12/1996 Calton ..... F24F 3/1411 62/223
5,772,710 A * 6/1998 Bauer ..... B01D 53/265 55/315.2
6,427,454 B1 * 8/2002 West ..... F24F 3/153 62/176.1
6,895,774 B1 * 5/2005 Ares ..... B01D 53/265 62/332
7,201,013 B2 * 4/2007 Yabu ..... B01D 53/261 62/271

(Continued)

*Primary Examiner* — Kun Kai Ma

(57) ABSTRACT

One aspect provides a dehumidifier that has a dehumidifying circuit and includes an evaporator, a first portion of a condensing circuit, and a first blower configured to direct a first air stream along a first flow path and through the evaporator and the first portion of the condensing circuit, for reducing the humidity of the first air stream. The dehumidifier also comprises a heat removing circuit, comprising a second blower configured to direct a second air stream along a second flow path and through a second portion of the condensing circuit for removing heat from the second portion of the condensing circuit. The first and second condensing circuits are fluidly coupled.

6 Claims, 6 Drawing Sheets

(56) References Cited

U.S. PATENT DOCUMENTS

| | | | | |
|---|---|---|---|---|
| 7,779,643 | B2 * | 8/2010 | Simons | F24F 3/153 62/188 |
| 2003/0154724 | A1 * | 8/2003 | Urch | F24F 12/006 62/3.2 |
| 2005/0198976 | A1 * | 9/2005 | Wright | F24F 3/153 62/93 |
| 2008/0230206 | A1 * | 9/2008 | Lestage | F24F 3/147 165/48.1 |
| 2009/0126387 | A1 * | 5/2009 | Dinh | F24F 3/153 62/272 |
| 2009/0308099 | A1 * | 12/2009 | Matsui | F24F 3/001 62/476 |
| 2010/0275621 | A1 * | 11/2010 | Oliveira, Jr. | A23L 3/40 62/93 |
| 2011/0308265 | A1 * | 12/2011 | Phannavong | F24F 12/001 62/160 |
| 2012/0247132 | A1 * | 10/2012 | Lakdawala | F24F 5/0071 62/79 |

* cited by examiner

DEHUMIDIFIER HAVING SPLIT CONDENSER CONFIGURATION

CROSS REFERENCE TO RELATED INFORMATION

This application is a continuation of U.S. patent application Ser. No. 13/300,909, filed Nov. 21, 2011, titled "Dehumidifier Having Split Condenser Configuration", now U.S. Pat. No. 9,631,834, the contents of which are hereby incorporated herein in its entirety.

TECHNICAL FIELD

This application is directed, in general, to a dehumidifier and, more specifically, to a dehumidifier having a split condenser configuration.

BACKGROUND OF THE INVENTION

Dehumidifiers, in general, are well known and have best application in regions where humidity is typically high. The dehumidifier uses an evaporator that has cool refrigerant moving through it to strip the moisture from the air. The evaporator is always paired with a single corresponding condenser in order to effect proper heat transfer within the system. The dehumidifier employs a conventional refrigeration cycle to remove moisture from the air by sending cooled refrigerant through the evaporator. The warmer moist air encounters the cooled tubes and fins of the evaporator, which causes the water to condense out from the air, thereby removing the humidity. The cooler air is then forced through a condenser, where heat is transferred from the condenser to the cooler air. This heat transfer increases the temperature of the air stream. After passing through the condenser, the warmed, dehumidified air is then passed into the indoor space where it mixes with other conditioned air, thereby lowering the overall humidity within the indoor space.

BRIEF SUMMARY OF THE INVENTION

One aspect provides a dehumidifier, comprising, a dehumidifying circuit that comprises an evaporator, a first portion of a condensing circuit, and a first blower configured to direct a first air stream along a first flow path and through the evaporator and the first portion of the condensing circuit, for reducing the humidity of the first air stream. The dehumidifier also comprises a heat removing circuit, comprising a second blower configured to direct a second air stream along a second flow path and through a second portion of the condensing circuit for removing heat from the second portion of the condensing circuit. The first and second condensing circuits are fluidly coupled.

Another aspect provides a method of manufacturing a dehumidifier. This method comprises forming a dehumidifying circuit, comprising placing an evaporator adjacent a first portion of a condensing circuit, and placing a first blower adjacent the evaporator such that the first blower is positioned to direct a first air stream along a first flow path and through the evaporator and the first portion of the condensing circuit, for reducing the humidity of the first air stream. This method also comprises forming a heat removing circuit, comprising placing a second blower adjacent a second air stream, such that the second blower is positioned to direct a second air stream along a second flow path and through a second portion of the condensing circuit for removing heat from the second portion of the condensing circuit. The first and second condensing circuits are fluidly coupled.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The embodiments discussed herein provide a dehumidifier that increases cooling efficiency while reducing humidity by expelling a portion of the heat transferred from a condensing circuit to an area outside the cooled space that would otherwise be placed back into the very space that is being cooled. This is in contrast to conventional dehumidifiers that, while removing humidity, return all of the heated air back into the cooled space. This conventional configuration introduces a significant amount of heat into the space intended to be cooled by a refrigerated cooling system. The various embodiments discussed herein provide a dehumidifier having a split condenser configuration that allows for a portion of the heat generated by the condensing circuit to be removed from the system by expelling that heat to an outdoor space versus introducing that heat back into a conditioned, indoor space. Moreover, the embodiments as set forth herein may be used in conjunction with known cooling/dehumidification systems, such as those described in U.S. Pat. Nos. 6,427,461, 6,664,049, 6,826,921 and 7,823,404, which are incorporated herein by reference.

A split condenser configuration involves the use of one or more condenser panels, which form a condensing circuit, in which a portion of the heat transferred to an air stream from the condensing circuit is passed to an outdoor space, while another portion of the heat transferred to another air stream is passed into an indoor space. In each configuration, the condenser panel or panels are fluidly coupled together. The split condenser configurations allows for more efficiency in the cooling operation in that the cooling system does not have to cool down all of the heat transferred from the condensing circuit, since a portion of that heat is expelled outside the conditioned space. This causes the cooling system to work less, thereby saving energy and operation costs.

Figure 1:
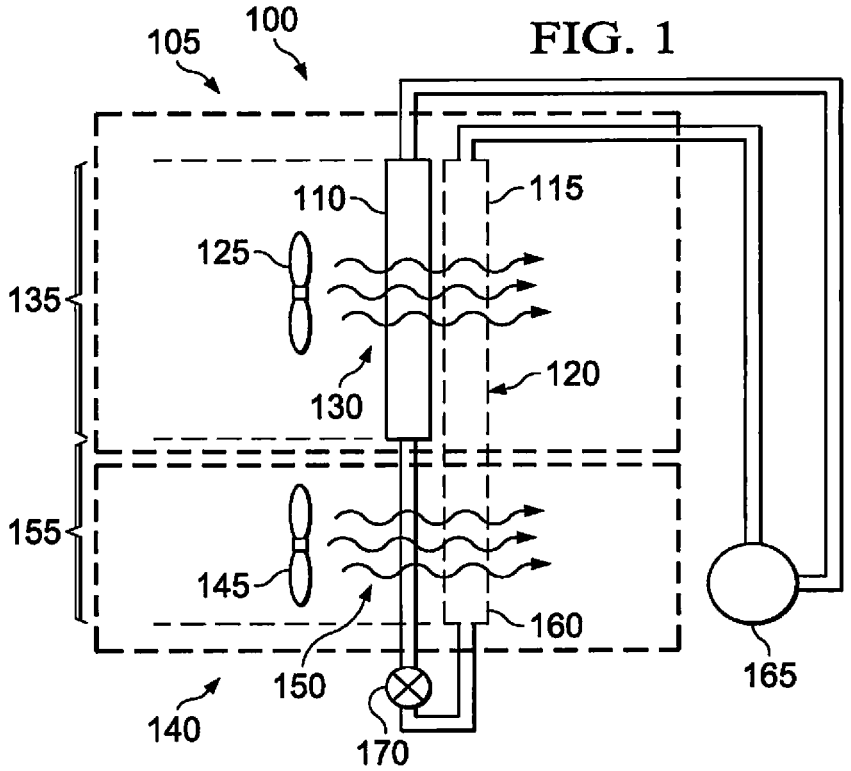
FIG. 1 illustrates a schematic view of one embodiment of a dehumidifier having a split condenser configuration, as provided herein.

FIG. 1 illustrates a schematic view of one general embodiment of a dehumidifier, as provided herein. In this embodiment, a dehumidifier 100 comprises a dehumidifying circuit 105 that comprises an evaporator 110, a first portion 115 of a condensing circuit 120, and a first blower 125 configured to direct a first air stream 130 along a first flow path 135 and through the evaporator 110 and the first portion 115 of the condensing circuit 120, for reducing the humidity of the first air stream 130. The illustrated embodiment further comprises a heat removing circuit 140, comprising a second blower 145 configured to direct a second air stream 150 along a second flow path 155 and through a second portion 160 of the condensing circuit 120 for removing heat from the second portion 160. The first and second condensing circuits 115, 160 are fluidly coupled by refrigerant tubing, which is not shown in this view. Other conventional components typically found in a refrigeration system may also be included, such as a compressor, 165 and an expansion valve 170.

As discussed and shown below, the condensing circuit 120, in certain embodiments comprises a single condenser panel that occupies space in each of the dehumidifying circuit 105 and the heat removing circuit 140. However, in other embodiments, the condensing circuit 120 comprises two or more distinct and physically separate condenser panels that are coupled to each other by way of a refrigerant tube.

Figure 2B:
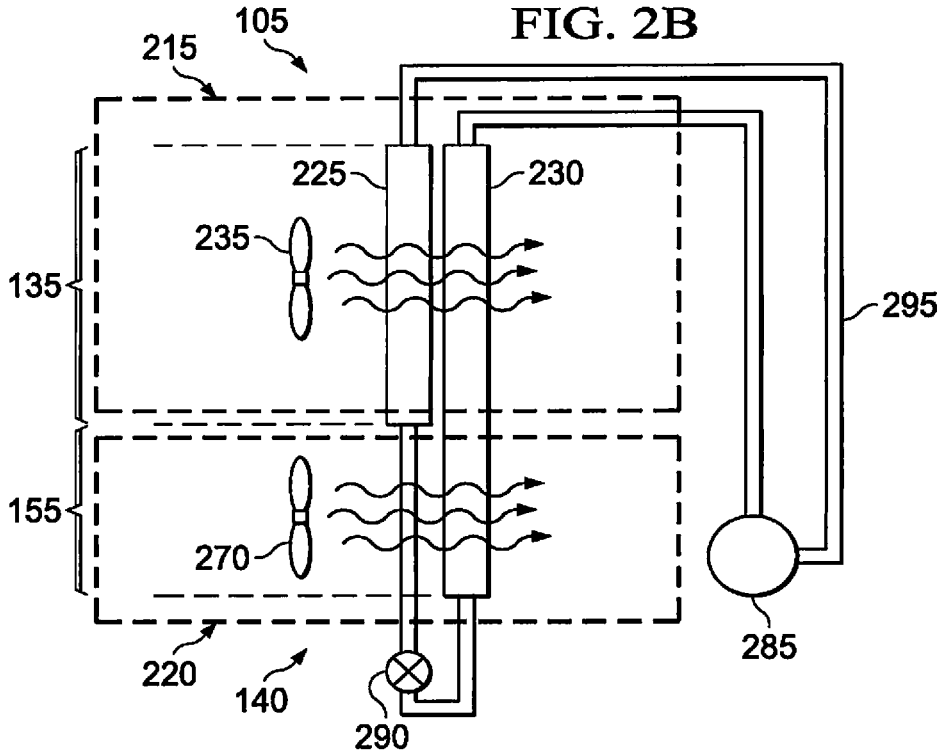
FIG. 2B illustrates a schematic view of the embodiment of FIG. 2A.
Figure 2A:
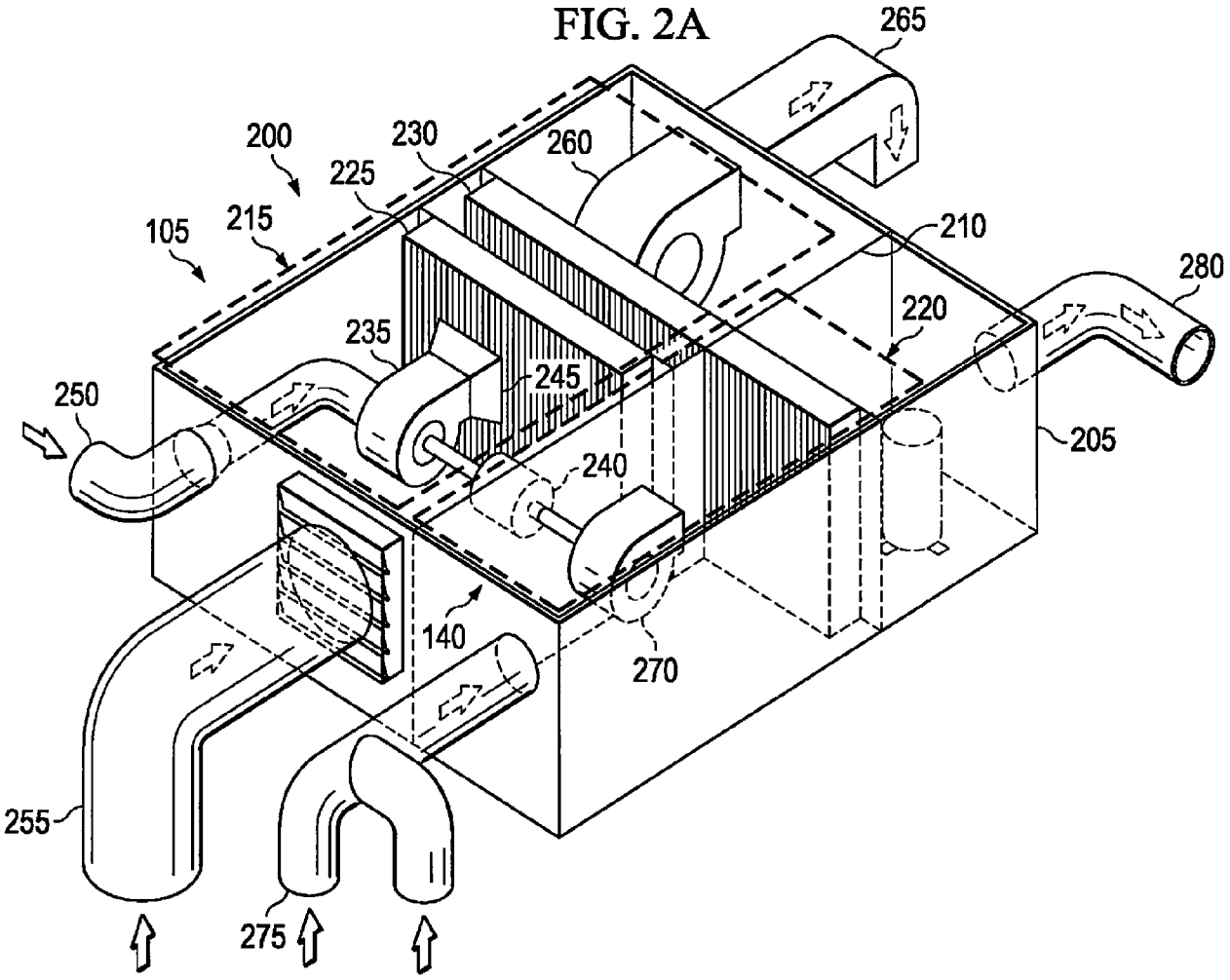
FIG. 2A illustrates another embodiment of a dehumidifier having a split condenser configuration, as provided herein.

FIG. 2A illustrates an embodiment of a dehumidifier 200 that includes the dehumidification circuit 105 and heat removing circuit 140, as discussed above. This embodiment includes a housing 205 in which the dehumidification components are housed. The housing 205 has an internal wall 210 that partitions the housing 205 into a dehumidification region 215, which houses components of the dehumidification circuit 105, and a heat removing region 220, which houses components of the heat removing circuit 140. The internal wall 210 also forms a segregated air flow path within the housing 205. An evaporator 225 is located in the dehumidification region 215 and is positioned in front of a portion of the condensing circuit, which in this embodiment is a single condenser panel 230.

As seen in this embodiment, a portion of the condenser panel 230 extends into the heat removing region 220. Since the condenser circuit, in this embodiment, is the single condenser panel 230, the two above-mentioned portions are fluidly coupled to one another, such that refrigerant within the condensing circuit flows between the dehumidification region 215 and the heat removing region 220. A blower 235 is located in the dehumidification region 215 and is positioned to direct air through the evaporator 225 and the portion of the condenser panel 230 that is located in the dehumidification region 215. The blower 235 is driven by a motor 240 and, in one embodiment, is fluidly coupled to a portion of the evaporator panel 225 by a plenum 245. The plenum 245 helps to prevent the outside air from mixing with other air flowing through the housing 205.

The housing 205 is configurable to provide an outside air duct 250 and an inside air return duct 255 to the dehumidification region 215. The outside air duct 250 is fluidly coupled to the plenum 245, as shown. As used herein and in the claims, "configurable" means the housing 205 is comprised of a material in which openings can be formed and to which air ducts can be attached at the desired locations on the housing 205. The air ducts 250 and 255 fluidly couple the dehumidification region 215 with outside air and inside air, respectively. A primary blower 260 is also located in the dehumidification region 215 and is fluidly coupled to an inside conditioned space by an air supply duct 265.

A blower 270 is also located in the heat removing region 220 and in front of that portion of the condensing panel 230 that extends into the heat removing region 220. In this particular embodiment, the motor 240 drives both blowers 235 and 270, but in other embodiments, each blower 235, 270 may be driven by separate motors. The heat removing region 220 also includes an intake air duct 275 that fluidly couples the heat removing region 220 to an indoor space and further includes an exhaust air duct 280 that fluidly couples the heat removing region 220 to an outdoor space.

The following operational discussion is given for illustrative purposes only, and it should be understood that the rates and air temperatures stated herein may vary and depend on a number of operational parameters. During this illustrative operation of the dehumidifier 200, outside air, for example, having a temperature of about 80.degree. F. is pulled into the dehumidification region 215 by the blower 235 at a rate of about 75 cubic feet per minutes (CFM). The blower 235 forces the air through the evaporator 225, which strips the humidity from the air by way of condensation and cools the air. The dehumidified and cooled outside air is then forced through that portion of the condenser panel 230 that resides in the dehumidifying region 215 where heat from the condenser panel 230 is transferred to the cooled air stream. At the same time, air having a temperature of about 80.degree. F., from the indoor space is being pulled into the dehumidification region 215 through air duct 255 by the primary blower 260 at a rate of about 200 CFM. The indoor air is also pulled through the evaporator 225 and that portion of the condenser panel 230 that resides in the dehumidification region 215 by blower 260, and is then forced back into the indoor space by way of the supply air duct 265 at a rate of about 275 CFM and at a temperature of about 94.degree. F. When passing through the condenser panel 230, heat transfer occurs between the cooler air stream and the condenser panel 230 and causes the temperature of the air stream to rise. This heat is then moved into the indoor space by air duct 265.

Indoor air, having a temperature of about 80.degree. F. is pulled into the heat removing region 220 through air duct 275 at a rate of about 75 CFM. However, unlike the air in the dehumidifying region 215, this air is not passed through an evaporator, but proceeds through that portion of the condenser panel 230 that resides in the heat removing region 220. It should be noted that the embodiments set forth herein do not preclude the use of an evaporator in the heat removing region 220. As the cooler air from the indoor space passes through the condenser panel 230, heat is transferred from the condensing panel 230 to the cooler air, which can cause the air to warm to about 140.degree. F. is then passed to the outdoor space by way of air duct 280 at a rate of about 75 CFM. As such, air, having a temperature of about 140.degree. F., that would otherwise be passed to the indoor space is removed from the system. Since this heat is not placed back into the indoor space, the air conditioning system used to cool the indoor space has less total heated air to cool, which reduces energy consumption and operational costs.

This configuration is in stark contrast to conventional dehumidification units where all the heat from the condenser is placed back into the indoor space. This heated air causes the temperature within the indoor space to rise, making the cooling system work harder and longer to reduce the total air temperature of the indoor space to the temperature set point.

FIG. 2B illustrates a schematic diagram of the dehumidifier 200 shown in FIG. 2A and how it is fluidly connected to a compressor 285 and expansion valve 290 by tubing 295.

Figure 2C:
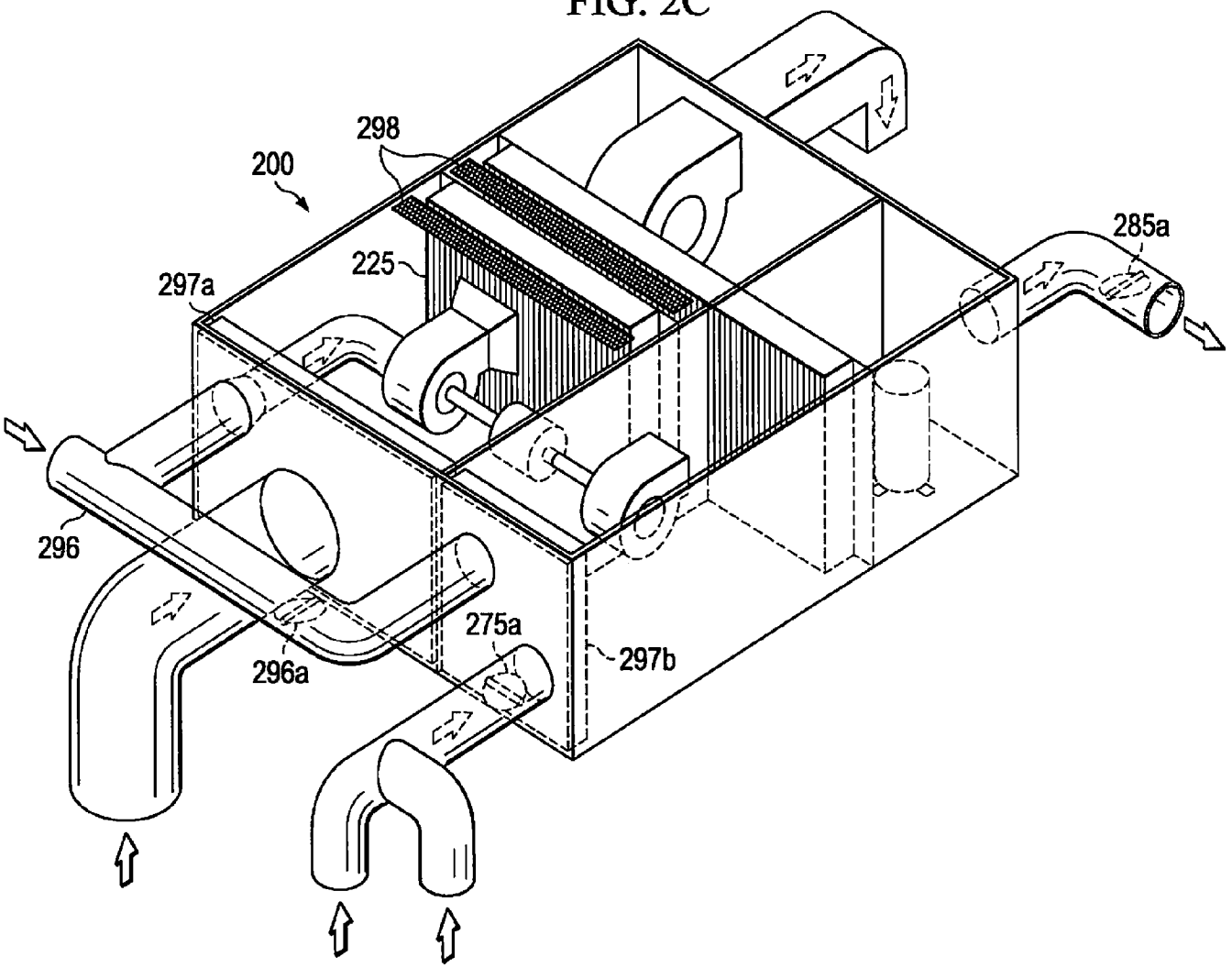
FIG. 2C illustrates another embodiment of the dehumidifier shown in FIG. 2A.

FIG. 2C illustrates another embodiment of the dehumidifier 200 shown in FIG. 2A. This embodiment illustrates additional components that can be present in certain embodiments. They may be present singly or in any combination. For simplicity only the new components are designated in this particular embodiment.

The dehumidifier 200 may include different air duct configurations, such as the one illustrated here. In this embodiment, an outside air duct 296 that extends to both the dehumidification region 215 and the heat removing region 220. Moreover, one or more of air ducts 275, 280, 296, may have automatic or manually controlled dampers, 275*a*, 280*a* and 296*a*, respectively, which allows for balancing of the intake outside air and exhaust air into and out of the dehumidifier 200. One or more filters 297*a*, 297*b*, may also be positioned within the housing 205 to filter particulates or gas phase contaminants from the respective air streams moving through the dehumidification region 215 and the heat removing region 220. The filters 297*a*, 297*b* may be configured to filter in the same manner or different manner. In one embodiment the filters 297*a*, 297*b* can have a minimum filtration efficiency of MERV 6 up to and including a HEPA filter. Moreover, the filters 297*a*, 297*b* may be comprised of a blend of activated carbon or other known primary absorbent materials, or they may be comprised of any number of additional gas phase filtration materials, including but not limited to potassium permanganate (KMnO.sub.4), TRIS (2-amino-2-hydroxymethyl-propane-1,3, diol) having a formula of (HOCH.sub.2)3CNH.sub.2, or manganese oxide (MnO.sub.x).

Certain embodiments of the dehumidifier 200 also includes ultraviolet lights 298 positioned adjacent the evaporator 225 to inhibit the growth of mold or bacteria within the dehumidifier 200.

Figure 3A:
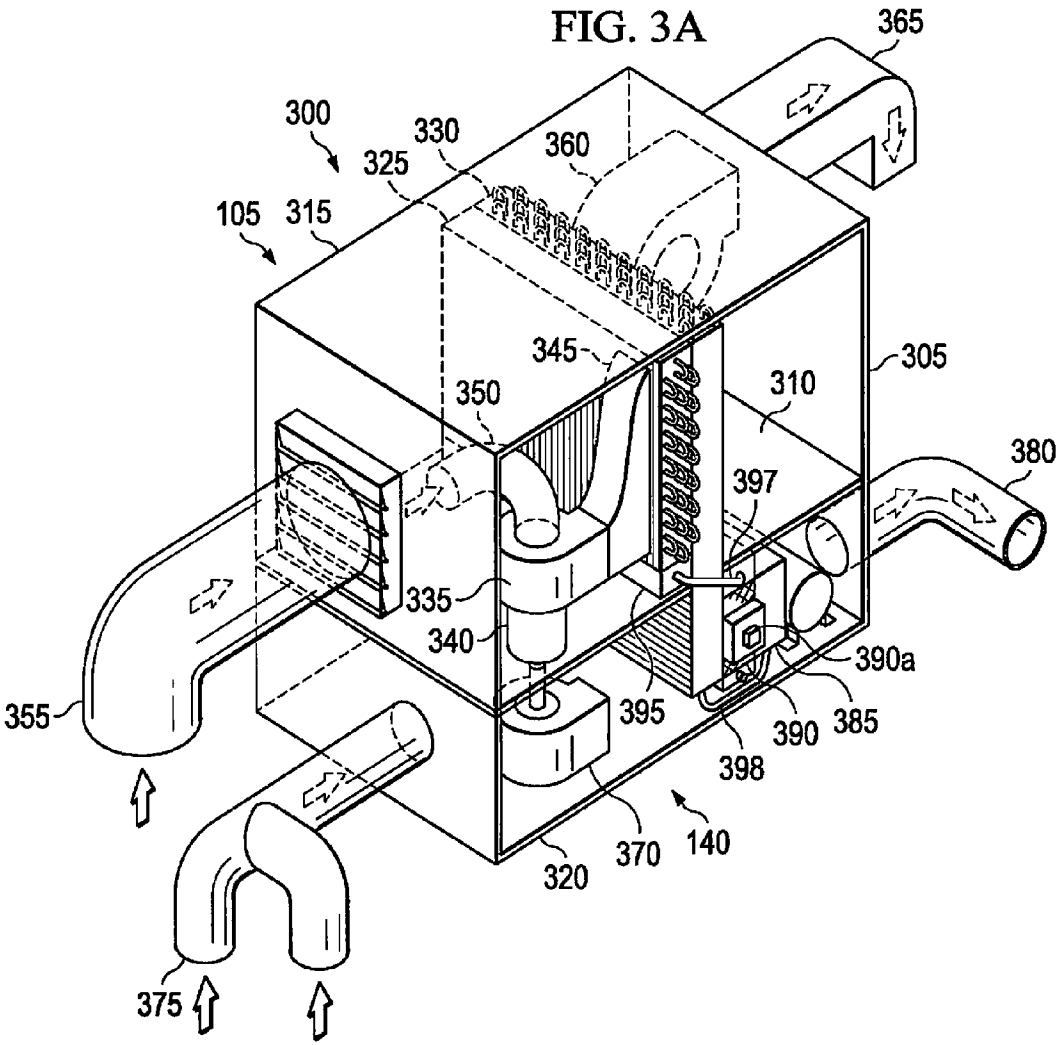
FIG. 3A illustrates another embodiment of a dehumidifier having a split condenser configuration, as provided herein.

FIG. 3A illustrates one configuration of an embodiment of a dehumidifier 300 that includes the dehumidification circuit 105 and heat removing circuit 140, as discussed above. This embodiment includes a housing 305 in which the dehumidification components are housed. The housing 305 has an internal wall 310 that partitions the housing 305 into a dehumidification region 315, which houses components of the dehumidification circuit 105, and a heat removing region 320, which houses components of the heat removing circuit 140. The internal wall 310 also forms a segregated air flow path within the housing 305. An evaporator 325 is located in the dehumidification region 315 and is positioned in front of a portion of the condensing circuit, which in this embodiment includes at least condenser panel 330 and another condenser panel as discussed below.

As seen in this embodiment, a portion of the condenser panel 330 extends into the heat removing region 320. A blower 335 is located in the dehumidification region 315 and is positioned to direct air through the evaporator 325 and the portion of the condenser panel 330 that is located in the dehumidification region 315. The blower 335 is driven by a motor 340 and, in one embodiment, is fluidly coupled to a portion of the evaporator panel 325 by a plenum 345. The plenum 345 helps to prevent the outside air from mixing with other air flowing through the housing 305.

The housing 305 is configurable to provide an outside air duct 350 and an inside air return duct 355 to the dehumidification region 315. The outside air duct 350 is fluidly coupled to the plenum 345, as shown. The air ducts 350 and 355 fluidly couple the dehumidification region 315 with outside air and inside air, respectively. A primary blower 360 is also located in the dehumidification region 315 and is fluidly coupled to an inside conditioned space by an air supply duct 365.

A blower 370 is located in the heat removing region 320 and in front of that portion of the condensing panel 330 that extends into the heat removing region 320. In this particular embodiment motor 340 drives both blowers 335 and 370, but in other embodiments, each blower 335, 370 may be driven by separate motors. The heat removing region 320 also includes an intake air duct 375 that fluidly couples the heat removing region 320 to an indoor space and further includes an exhaust air duct 380 that fluidly couples the heat removing region 320 to an outdoor space.

The condensing circuit of dehumidifier 300 further includes a second condenser 385 that is located in the heat removing region 320 and makes up a portion of the condensing circuit 140. An evaporative pad 390 is located between the portion of the condenser panel 330 that is located in the heat removing region 320 and the second condenser 385. In some embodiments a humidity control sensor 390*a* is also present. The humidity control sensor 390*a* is configured to run the blower 370 until the moisture within the evaporative pad 390 is substantially evaporated. The evaporator 325 panel sits in a drain pan 395 and collects cold water that drains from the evaporator panel 325. The drain pan 395 is coupled to a conduit 397 that extends from the drain pan 395 to the evaporative pad 390 and allows cold water to run onto the evaporative pad 390. The condenser panel 330 and the second condenser 385 are fluidly coupled together by refrigerant tubing 398.

During operation of the dehumidifier 300, outside air is pulled into the dehumidification region 315 by the blower 335. The blower 335 forces the air through the evaporator 325, which strips the humidity from the air by way of condensation and cools the air. The dehumidified and cooled outside air is then forced through that portion of the condenser panel 330 that resides in the dehumidifying region 315 where heat from the condenser panel 330 is transferred to the cooled air stream. As the evaporator panel 325 dehumidifies the air stream traveling through the dehumidification region 315, cold water forms on the evaporator panel 325 and runs down and collects in the drain pan 395. The cold water is then transported to the evaporative pad 390 by way of the conduit 397. At the same time, air from the indoor space is being pulled into the dehumidification region 315 through air duct 355 by the primary blower 360. The indoor air is also pulled through the evaporator 325 and that portion of the condenser panel 330 that resides in the dehumidification region 315 by blower 360, and is then forced back into the indoor space by way of the supply air duct 365. When passing through the condenser panel 330, heat transfer occurs between the cooler air stream and the condenser panel 330 and causes the temperature of the air stream to rise. This heat is then moved into the indoor space by air duct 365.

As the dehumidification process is taking place, indoor air is pulled into the heat removing region 320 through air duct 375. However, unlike the air in the dehumidifying region 315, this air is not passed through an evaporator, but proceeds through that portion of the condenser panel 330 that resides in the heat removing region 320. Heat is transferred from the condenser panel 330 to the air stream and becomes warmer. The air stream passes through the cooled evaporative pad 390 and heat is removed from the air stream and becomes cooler than the air that entered the evaporative pad 390 from the condenser panel 330. Because the air stream is cooler by virtue of passing through the evaporative pad 390, the air stream has a greater heat transfer capacity. The cooled air stream from the evaporative pad 390 then passes through the second condenser 385, which is fluidly coupled to the condenser panel 330, where further heat is removed from the condensing circuit. The warmed air stream then passes out of the dehumidifier 300 by way of exhaust air duct 380. As such, heat that would otherwise be passed to the indoor space is removed from the system. Since this heat is not placed back into the indoor space, the air conditioning system used to cool the indoor space has less total heated air to cool, which reduces energy consumption and operational costs. This embodiment provides the same advantages over conventional dehumidification units as the previously discussed embodiments.

Figure 3B:
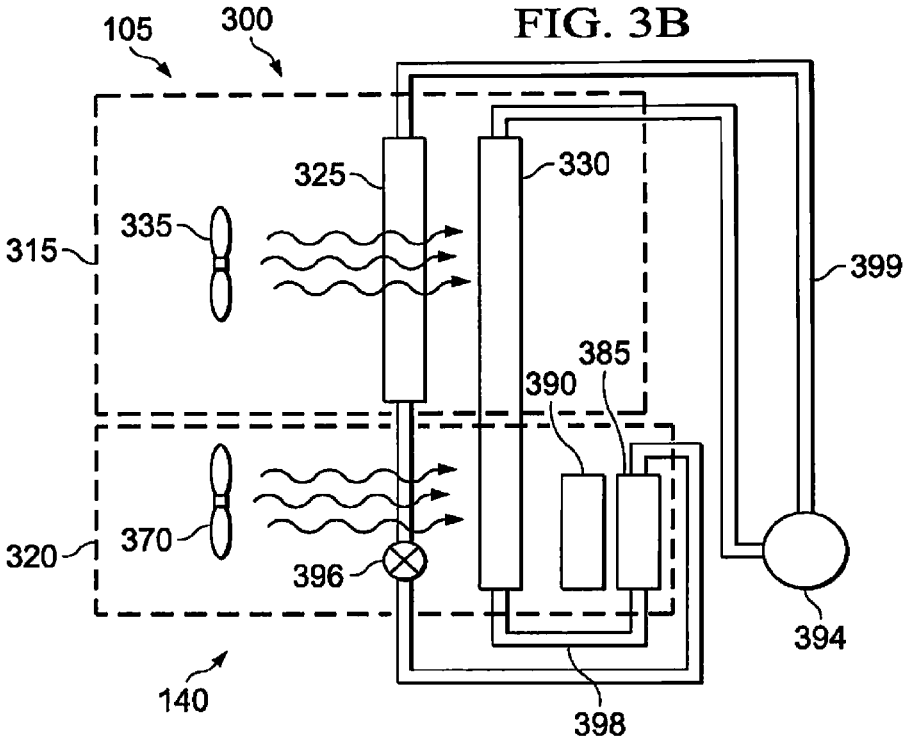
FIG. 3B illustrates a schematic view of the embodiment of FIG. 3A.

FIG. 3B illustrates a schematic diagram of the dehumidifier 300 shown in FIG. 3A and how it is fluidly connected to a compressor 394 and expansion valve 396 by tubing 399.

Figure 4A:
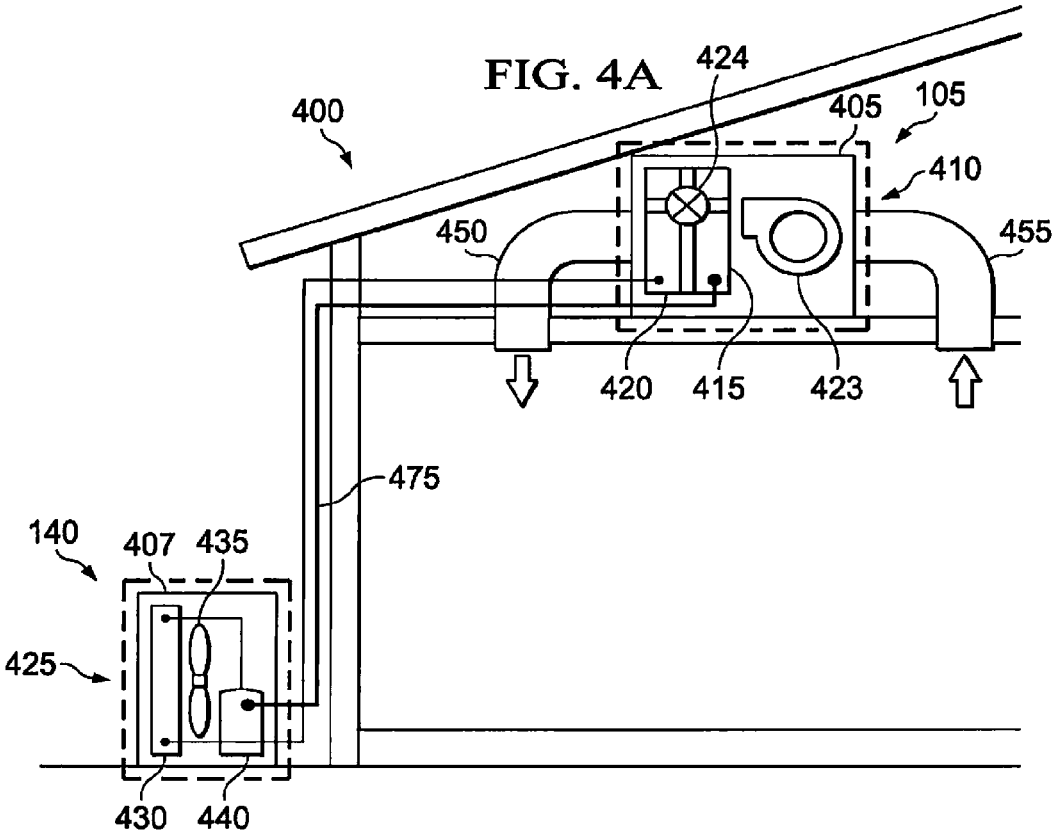
FIG. 4A illustrates yet another embodiment of a dehumidifier having a split condenser configuration, as provided herein.

FIG. 4A illustrates another embodiment of a dehumidifier 400 that includes the dehumidification circuit 105 and heat removing circuit 140, as discussed above. This system is particularly applicable in those instances where outside air ducts are not present. This embodiment includes an indoor housing 405 in which the dehumidification components are housed and an outdoor housing 407 in which the heat removing components are housed. A dehumidification region 410, which comprises an evaporator 415, a first condenser 420, a first blower 423 and expansion valve 424, is located in indoor housing 405. A heat removing region 425 is located in the outdoor housing 407 and comprises a second condenser 430, a second blower 435, and a compressor 440. The first and second condensers 420 and 430 form a condensing circuit for this embodiment. It should be understood that, in other embodiments, compressor 440 may be located in housing 405 or may be placed in some other located adjacent either housing 405 or housing 407. The first and second condenser 420 and 430 are fluidly coupled by tubing 445.

The indoor housing 405 is configurable to provide an inside return air duct 455 and an inside supply air duct 450 to the dehumidification region 410. The air ducts 450 and 455 fluidly couple the dehumidification region 410 with the inside conditioned space, respectively.

During operation of the dehumidifier 400, inside air is pulled into the dehumidification region 410 by the blower 423 through air duct 455. The blower 423 forces the air through the evaporator 415, which strips the humidity from the air by way of condensation and cools the air. The dehumidified and cooled air is then forced through the condenser panel 420 that resides in the dehumidifying region 410 where heat from the condenser panel 420 is transferred to the cooled air stream. The dehumidified air is then forced back into the indoor space by way of the supply air duct 450. When passing through the condenser panel 420, heat transfer occurs between the cooler air stream and the condenser panel 420 and causes the temperature of the air stream to rise. This heat is then moved into the indoor space through air duct 450.

Additional heat is removed from the system through condenser 430, which is located outdoors but is coupled to the indoor condenser 420 by refrigerant tubing 445. The outside air, which will be cooler than the refrigerant flowing through the condenser 430, even on the hottest of days, is driven through the condenser 430 by fan 435 and is not passed through an evaporator. As the relative cooler outside air passes through the condenser panel 430, heat is transferred from the condenser 430 to the cooler air passing through the condenser 430, which is then passed to the outdoor air. As such, heat that would otherwise be passed to the indoor space is removed from the system. Since this heat is not placed back into the indoor space, the air conditioning system used to cool the indoor space has less total heated air to cool, which reduces energy consumption and operational costs.

Figure 4B:
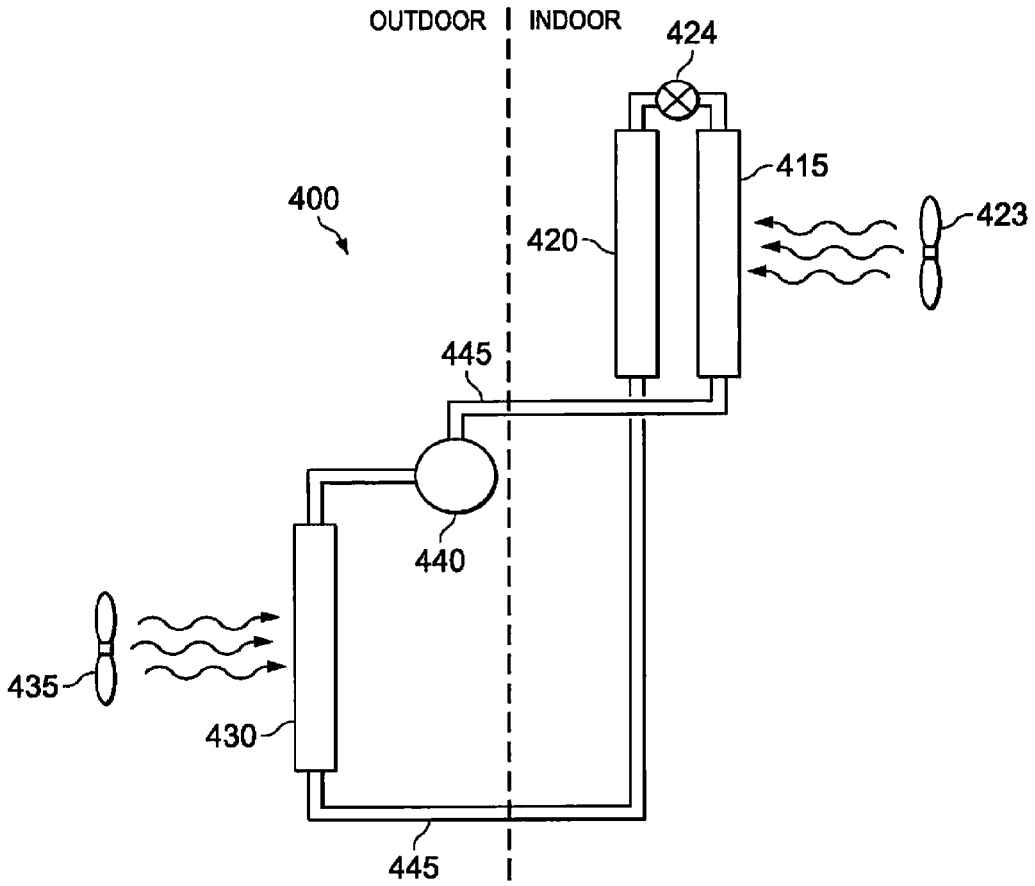
FIG. 4B illustrates a schematic view of the embodiment of FIG. 4A.

FIG. 4B illustrates a schematic diagram of the dehumidifier 400 shown in FIG. 4A and how it is fluidly connected to the compressor 440 and the condenser 430 by tubing 445.

Those skilled in the art to which this application relates will appreciate that other and further additions, deletions, substitutions and modifications may be made to the described embodiments.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of manufacturing a dehumidifier, comprising:

forming a dehumidifying circuit, comprising placing an evaporator adjacent a first portion of a condensing circuit, the first portion of the condensing circuit comprising a first condenser panel, wherein said evaporator is placed in a drain pan, and placing a first blower adjacent said evaporator such that said first blower is positioned to direct a first air stream along a first flow path and through said evaporator and said first portion of said condensing circuit, for reducing a humidity of said first air stream;

forming a heat removing circuit, comprising placing a second blower adjacent a second air stream, such that said second blower is positioned to direct a second air stream along a second flow path and through a second portion of said condensing circuit for removing heat from said second portion of said condensing circuit, the second portion of the condensing circuit comprising a second condenser panel, said first portion of the condensing circuit and said second portion of the condensing circuits being fluidly coupled;

positioning a first portion of said first condenser panel in said dehumidifying region;

positioning a second portion of said first condenser panel in said heat removing region;

fluidly coupling the second condenser panel to said first condenser panel and positioning said second condenser panel in said heat removing region, and positioning an evaporative pad in said heat removing region between said second portion of said first condenser panel and said second condenser panel; and coupling a conduit that extends from said drain pan to said evaporative pad; and positioning said dehumidifying circuit and said heat removing circuit in a common housing having a wall that divides said housing into a dehumidifying region and a heat removing region, positioning said first blower in said dehumidifying region and positioning said second blower in said heat removing region.

2. The method recited in claim 1, further comprising positioning a third blower in said dehumidifying region and fluidly coupling said third blower to an indoor space by a supply air duct.

3. The method recited in claim 1, wherein said common housing is configurable to fluidly couple said dehumidifying region to an indoor space by a first return air duct and is configurable to fluidly couple said heat removing region to said indoor space by a second return air duct and couple said heat removing region to an outdoor space by an exhaust air duct.

4. The method recited in claim 3, wherein said common housing is configurable to fluidly couple said dehumidifying region to said outdoor space by an intake air duct.

5. The method recited in claim 1 further comprising positioning said dehumidifying circuit within an indoor space and positioning said heat removing circuit in an outdoor space, and coupling said first and second portions of said condensing circuit together by a refrigerant tube that extends between said first and second portions.

6. The method recited in claim 1, further comprising fluidly coupling said first blower to said evaporator by a plenum.

* * * * *